US006951108B2

(12) United States Patent
Burrus et al.

(10) Patent No.: US 6,951,108 B2
(45) Date of Patent: Oct. 4, 2005

(54) GAS TURBINE ENGINE COMBUSTOR CAN WITH TRAPPED VORTEX CAVITY

(75) Inventors: David Louis Burrus, Cincinnati, OH (US); Narendra Digamber Joshi, Cincinnati, OH (US); Joel Meier Haynes, Niskayuna, NY (US); Alan S. Feitelberg, Niskayuna, NY (US)

(73) Assignee: General Electric Company, Schenectady, NY (US)

( * ) Notice: Subject to any disclaimer, the term of this patent is extended or adjusted under 35 U.S.C. 154(b) by 178 days.

(21) Appl. No.: 10/762,993

(22) Filed: Jan. 22, 2004

(65) Prior Publication Data

US 2005/0034458 A1 Feb. 17, 2005

Related U.S. Application Data

(62) Division of application No. 10/166,960, filed on Jun. 11, 2002, now Pat. No. 6,735,949.

(51) Int. Cl.[7] ..... F23R 3/04
(52) U.S. Cl. ..... 60/746; 60/750
(58) Field of Search ..... 60/737, 746–748, 60/749, 750

(56) References Cited

U.S. PATENT DOCUMENTS 5,251,447 A 10/1993 Joshi et al.
5,259,184 A 11/1993 Borkowicz et al.
5,285,632 A 2/1994 Halila
5,351,477 A 10/1994 Joshi et al.
5,444,982 A 8/1995 Heberling et al.
5,511,375 A 4/1996 Joshi et al.
5,590,529 A 1/1997 Joshi et al.
5,613,363 A 3/1997 Joshi et al.
5,619,855 A 4/1997 Burrus
5,675,971 A 10/1997 Angel et al.
5,680,766 A 10/1997 Joshi et al.
5,791,148 A 8/1998 Burrus
5,816,049 A 10/1998 Joshi
5,822,992 A 10/1998 Dean
5,857,339 A 1/1999 Roquemore et al.
5,974,781 A 11/1999 Correa et al.
5,996,351 A 12/1999 Feitelberg et al.
6,047,550 A 4/2000 Beebe
6,141,967 A 11/2000 Angel et al.
6,164,055 A 12/2000 Lovett et al.
6,250,062 B1 6/2001 Lawen, Jr. et al.

(Continued)

*Primary Examiner*—Louis J. Casaregola
(74) *Attorney, Agent, or Firm*—William Scott Andes; Steven J. Rosen

(57) ABSTRACT

A gas turbine engine combustor can downstream of a pre-mixer has a pre-mixer flowpath therein and circumferentially spaced apart swirling vanes disposed across the pre-mixer flowpath. A primary fuel injector is positioned for injecting fuel into the pre-mixer flowpath. A combustion chamber surrounded by an annular combustor liner disposed in supply flow communication with the pre-mixer. An annular trapped dual vortex cavity located at an upstream end of the combustor liner is defined between an annular aft wall, an annular forward wall, and a circular radially outer wall formed therebetween. A cavity opening at a radially inner end of the cavity is spaced apart from the radially outer wall. Air injection first holes are disposed through the forward wall and air injection second holes are disposed through the aft wall. Fuel injection holes are disposed through at least one of the forward and aft walls.

9 Claims, 7 Drawing Sheets

U.S. PATENT DOCUMENTS 6,250,063 B1 6/2001 Davis, Jr. et al.
6,272,842 B1 8/2001 Dean
6,286,298 B1 9/2001 Burrus et al.
6,286,317 B1 9/2001 Burrus et al.
6,295,801 B1 10/2001 Burrus et al.
6,334,298 B1 1/2002 Aicholtz
6,363,724 B1 4/2002 Bechtel et al.
6,481,209 B1 11/2002 Johnson et al.

GAS TURBINE ENGINE COMBUSTOR CAN WITH TRAPPED VORTEX CAVITY

This is a divisional of application Ser. No. 10/166,960 filed on Jun. 11, 2002 now U.S. Pat. No. 6,735,949, which is hereby incorporated by reference herein.

This Invention was made with Government support under Contract No. DE-FC26-01NT41020 awarded by the Department of Energy. The Government has certain rights in this invention.

BACKGROUND OF THE INVENTION

The present invention relates to gas turbine engine combustors and, more particularly, to can-annular combustors with pre-mixers.

Industrial gas turbine engines include a compressor for compressing air that is mixed with fuel and ignited in a combustor for generating combustion gases. The combustion gases flow to a turbine that extracts energy for driving a shaft to power the compressor and produces output power for powering an electrical generator, for example. Electrical power generating gas turbine engines are typically operated for extended periods of time and exhaust emissions from the combustion gases are a concern and are subject to mandated limits. Thus, the combustor is designed for low exhaust emissions operation and, in particular, for low NOx operation. A typical low NOx combustor includes a plurality of combustor cans circumferentially adjoining each other around the circumference of the engine. Each combustor can has a plurality of pre-mixers joined to the upstream end. Lean burning pre-mixed low NOx combustors have been designed to produce low exhaust emissions but are susceptible to combustion instabilities in the combustion chamber.

Diatomic nitrogen rapidly disassociates at temperatures exceeding about 3000.degree. F. and combines with oxygen to produce unacceptably high levels of NOx emissions. One method commonly used to reduce peak temperatures and, thereby, reduce NOx emissions, is to inject water or steam into the combustor. However, water/steam injection is a relatively expensive technique and can cause the undesirable side effect of quenching carbon monoxide (CO) burnout reactions. Additionally, water/steam injection methods are limited in their ability to reach the extremely low levels of pollutants required in many localities. Lean pre-mixed combustion is a much more attractive method of lowering peak flame temperatures and, correspondingly, NOx emission levels. In lean pre-mixed combustion, fuel and air are pre-mixed in a pre-mixing section and the fuel-air mixture is injected into a combustion chamber where it is burned. Due to the lean stoichiometry resulting from the pre-mixing, lower flame temperatures and NOx emission levels are achieved. Several types of low NOx emission combustors are currently employing lean pre-mixed combustion for gas turbines, including can-annular and annular type combustors.

Can-annular combustors typically consist of a cylindrical can-type liner inserted into a transition piece with multiple fuel-air pre-mixers positioned at the head end of the liner. Annular combustors are also used in many gas turbine applications and include multiple pre-mixers positioned in rings directly upstream of the turbine nozzles in an annular fashion. An annular burner has an annular cross-section combustion chamber bounded radially by inner and outer liners while a can burner has a circular cross-section combustion chamber bounded radially by a single liner.

Industrial gas turbine engines typically include a combustor designed for low exhaust emissions operation and, in particular, for low NOx operation. Low NOx combustors are typically in the form of a plurality of combustor cans circumferentially adjoining each other around the circumference of the engine, with each combustor can having a plurality of pre-mixers joined to the upstream ends thereof. Each pre-mixer typically includes a cylindrical duct in which is coaxially disposed a tubular centerbody extending from the duct inlet to the duct outlet where it joins a larger dome defining the upstream end of the combustor can and combustion chamber therein.

A swirler having a plurality of circumferentially spaced apart vanes is disposed at the duct inlet for swirling compressed air received from the engine compressor. Disposed downstream of the swirler are suitable fuel injectors typically in the form of a row of circumferentially spaced-apart fuel spokes, each having a plurality of radially spaced apart fuel injection orifices which conventionally receive fuel, such as gaseous methane, through the centerbody for discharge into the pre-mixer duct upstream of the combustor dome.

The fuel injectors are disposed axially upstream from the combustion chamber so that the fuel and air has sufficient time to mix and pre-vaporize. In this way, the pre-mixed and pre-vaporized fuel and air mixture support cleaner combustion thereof in the combustion chamber for reducing exhaust emissions. The combustion chamber is typically imperforate to maximize the amount of air reaching the pre-mixer and, therefore, producing lower quantities of NOx emissions and thus is able to meet mandated exhaust emission limits.

Lean pre-mixed low NOx combustors are more susceptible to combustion instability in the combustion chamber which causes the fuel and air mixture to vary, thus, lowering the effectiveness of the combustor to reduce emissions. Lean burning low NOx emission combustors with pre-mixers are subject to combustion instability that imposes serious limitations upon the operability of pre-mixed combustion systems. There exists a need in the art to provide combustion stability for a combustor which uses pre-mixing.

BRIEF SUMMARY OF THE INVENTION

A gas turbine engine combustor can assembly includes a combustor can downstream of a pre-mixer having a pre-mixer upstream end, a pre-mixer downstream end, and a pre-mixer flowpath therebetween. A plurality of circumferentially spaced apart swirling vanes are disposed across the pre-mixer flowpath between the upstream and downstream ends. A primary fuel injector is used for injecting fuel into the pre-mixer flowpath. The combustor can has a combustion chamber surrounded by an annular combustor liner disposed in supply flow communication with the pre-mixer. An annular trapped dual vortex cavity is located at an upstream end of the combustor liner and is defined between an annular aft wall, an annular forward wall, and a circular radially outer wall formed therebetween. A cavity opening at a radially inner end of the cavity is spaced apart from the radially outer wall and extends between the aft wall and the forward wall. Air injection first holes are disposed through the forward wall and air injection second holes are disposed through the aft wall. The air injection first and second holes are spaced radially apart and fuel injection holes are disposed through at least one of the forward and aft walls.

An exemplary embodiment of the combustor can assembly includes angled film cooling apertures disposed through the aft wall angled radially outwardly in the downstream direction, film cooling apertures disposed through the forward wall angled radially inwardly, and film cooling apertures disposed through the outer wall angled axially forwardly. Alternatively, the film cooling apertures through the aft wall are angled radially inwardly in the downstream direction, the film cooling apertures through the forward wall are angled radially outwardly in the downstream direction, and the film cooling apertures through the outer wall are angled axially aftwardly. Each of the fuel injection holes is surrounded by a plurality of the air injection second holes and the air injection first holes are singularly arranged in a circumferential row. The primary fuel injector includes fuel cavities within the swirling vanes and fuel injection holes extending through trailing edges of the swirling vanes from the fuel cavities to the pre-mixer flowpath.

One alternative combustor can assembly has a reverse flow combustor flowpath including, in downstream serial flow relationship, an aft to forward portion between an outer flow sleeve and the annular combustor liner, a 180 degree bend forward of the vortex cavity, and the pre-mixer flowpath at a downstream end of the combustor flowpath. The swirling vanes are disposed across the pre-mixer flowpath defined between an outer flow sleeve and an inner flow sleeve. Another alternative combustor can assembly has a second stage pre-mixing convoluted mixer located between the pre-mixer and the vortex cavity. The convoluted mixer includes circumferentially alternating lobes extending radially inwardly into the pre-mixer flowpath.

BRIEF DESCRIPTION OF THE DRAWINGS

While the specification concludes with claims particularly pointing out and distinctly claiming the present invention, it is believed that the same will be better understood from the following description taken in conjunction with the accompanying drawings in which:

DETAILED DESCRIPTION OF THE INVENTION

Figure 1:
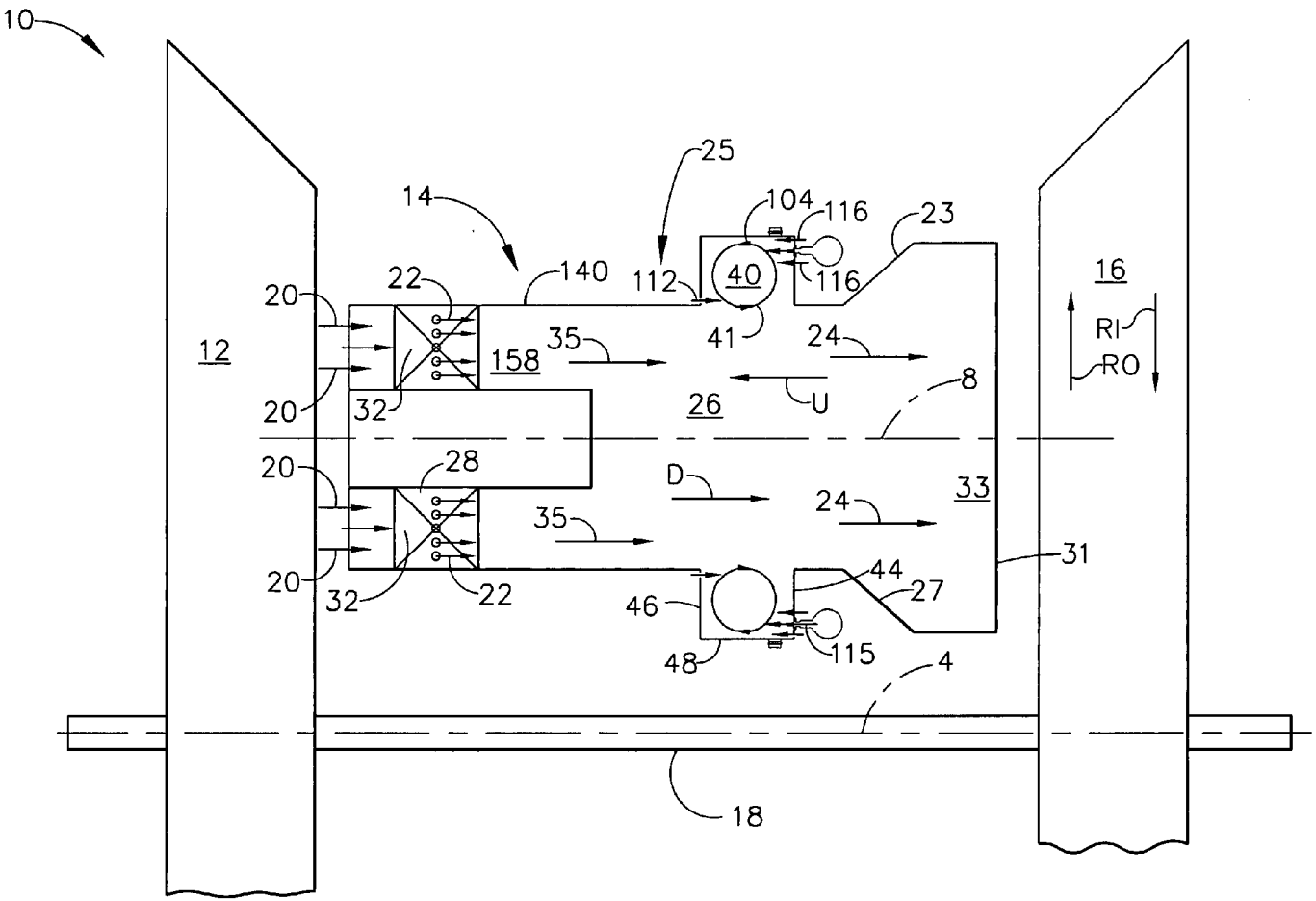
FIG. 1 is a schematic illustration of a portion of an industrial gas turbine engine having a low NOx pre-mixer and can combustor with a trapped vortex cavity in accordance with an exemplary embodiment of the present invention.

Illustrated in FIG. 1 is an exemplary industrial gas turbine engine 10 including a multi-stage axial compressor 12 disposed in serial flow communication with a low NOx combustor 14 and a single or multi-stage turbine 16. The turbine 16 is drivingly connected to compressor 12 by a drive shaft 18 which is also used to drive an electrical generator (not shown) for generating electrical power. During operation, the compressor 12 discharges compressed air 20 in a downstream direction D into the combustor 14 wherein the compressed air 20 is mixed with fuel 22 and ignited for generating combustion gases 24 from which energy is extracted by the turbine 16 for rotating the shaft 18 to power compressor 12 and driving the generator or other suitable external load. The combustor 14 is can-annular having a plurality of combustor can assemblies 25 circumferentially disposed about an engine centerline 4.

Figure 2:
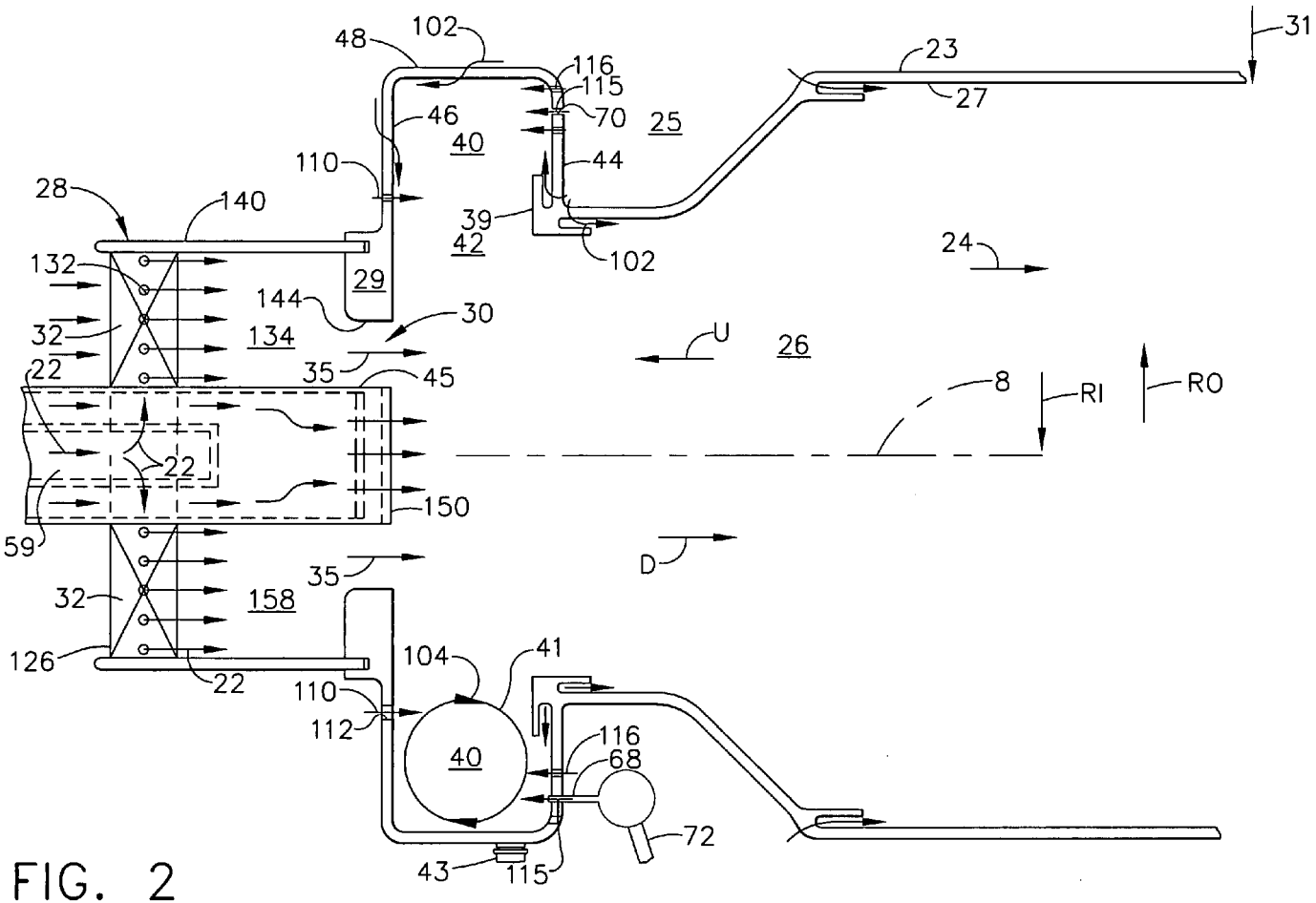
FIG. 2 is an enlarged longitudinal cross-sectional view illustration of the can combustor illustrated in FIG. 1.

Referring further to FIG. 2, each of the combustor can assemblies 25 includes a combustor can 23 directly downstream of a pre-mixer 28 that forms a main air/fuel mixture in a fuel/air mixture flow 35 in a pre-mixing zone 158 between the pre-mixer and the combustor can. The combustor can 23 includes a combustion chamber 26 surrounded by a tubular or annular combustor liner 27 circumscribed about a can axis 8 and attached to a combustor dome 29. The combustion chamber 26 has a body of revolution shape with circular cross-sections normal to the can axis 8. In the exemplary embodiment, the combustor liner 27 is imperforate to maximize the amount of air reaching the pre-mixer 28 for reducing NOx emissions. The generally flat combustor dome 29 is located at an upstream end 30 of the combustion chamber 26 and an outlet 31 is located at a downstream end 33 of the combustion chamber. A transition section (not illustrated) joins the plurality of combustor can outlets 31 to effect a common annular discharge to turbine 16.

The lean combustion process associated with the present invention makes achieving and sustaining combustion difficult and associated flow instabilities effect the combustors low NOx emissions effectiveness. In order to overcome this problem within combustion chamber 26, some technique for igniting the fuel/air mixture and stabilizing the flame thereof is required. This is accomplished by the incorporation of a trapped vortex cavity 40 formed in the combustor liner 27. The trapped vortex cavity 40 is utilized to produce an annular rotating vortex 41 of a fuel and air mixture as schematically depicted in the cavity in FIGS. 1, 2 and 3.

Figure 3:
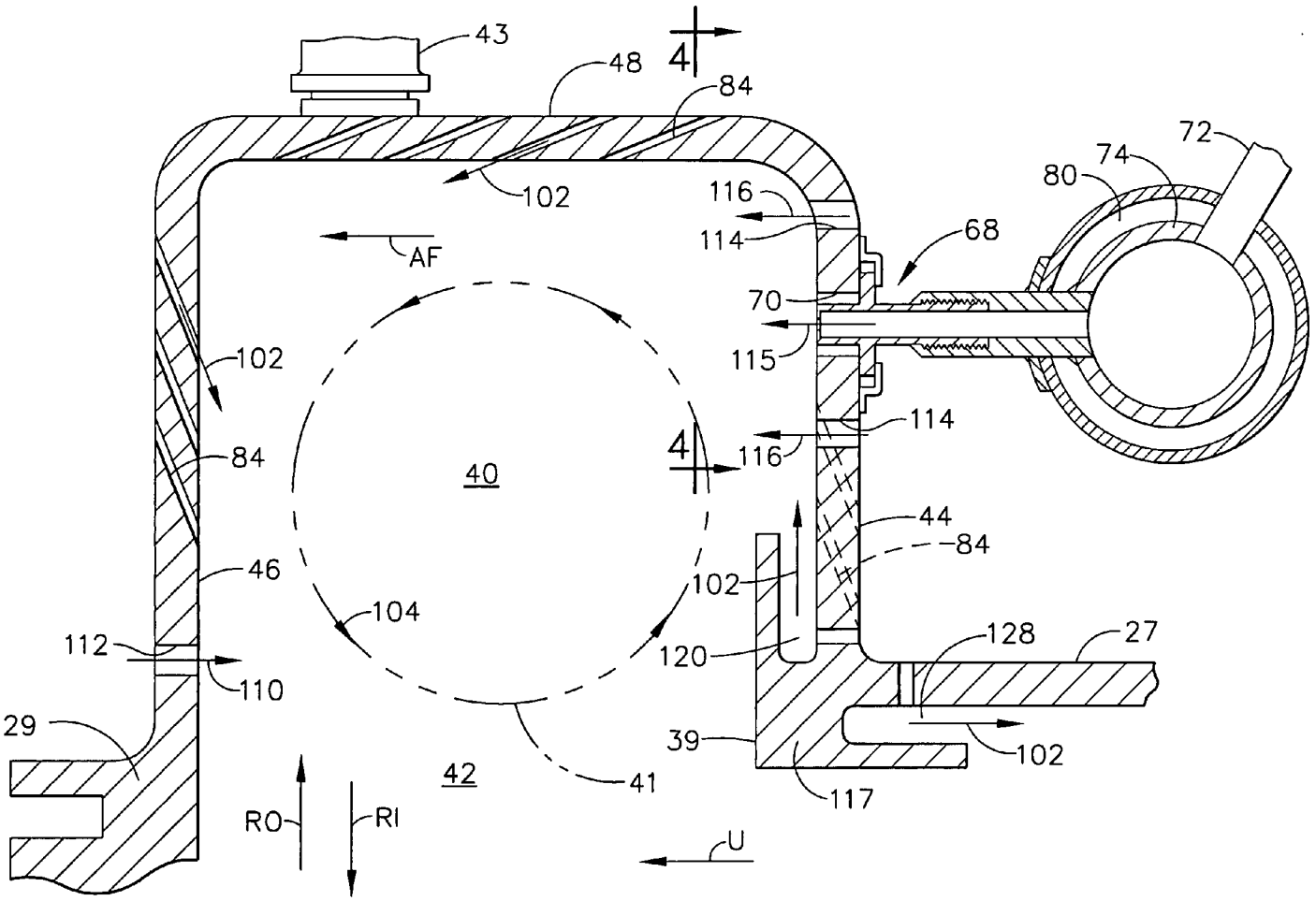
FIG. 3 is an enlarged longitudinal cross-sectional view illustration of the trapped vortex cavity illustrated in FIG. 2.

Referring to FIG. 3, an igniter 43 is used to ignite the annular rotating vortex 41 of a fuel and air mixture and spread a flame front into the rest of the combustion chamber 26. The trapped vortex cavity 40 thus serves as a pilot to ignite the main air/fuel mixture in the air/fuel mixture flow 35 that is injected into the combustion chamber 26 from the air fuel pre-mixer 28. The trapped vortex cavity 40 is illustrated as being substantially rectangular in shape and is defined between an annular aft wall 44, an annular forward wall 46, and a circular radially outer wall 48 formed therebetween which is substantially perpendicular to the aft and forward walls 44 and 46, respectively. The term "aft" refers to the downstream direction D and the term "forward" refers to an upstream direction U.

A cavity opening 42 extends between the aft wall 44 and the forward wall 46 at a radially inner end 39 of the cavity 40, is open to combustion chamber 26, and is spaced radially apart and inwardly of the outer wall 48. In the exemplary embodiment illustrated herein, the vortex cavity 40 is substantially rectangular in cross-section and the aft wall 44, the forward wall 46, and the outer wall 48 are approximately equal in length in an axially extending cross-section as illustrated in the FIGS.

Figure 4:
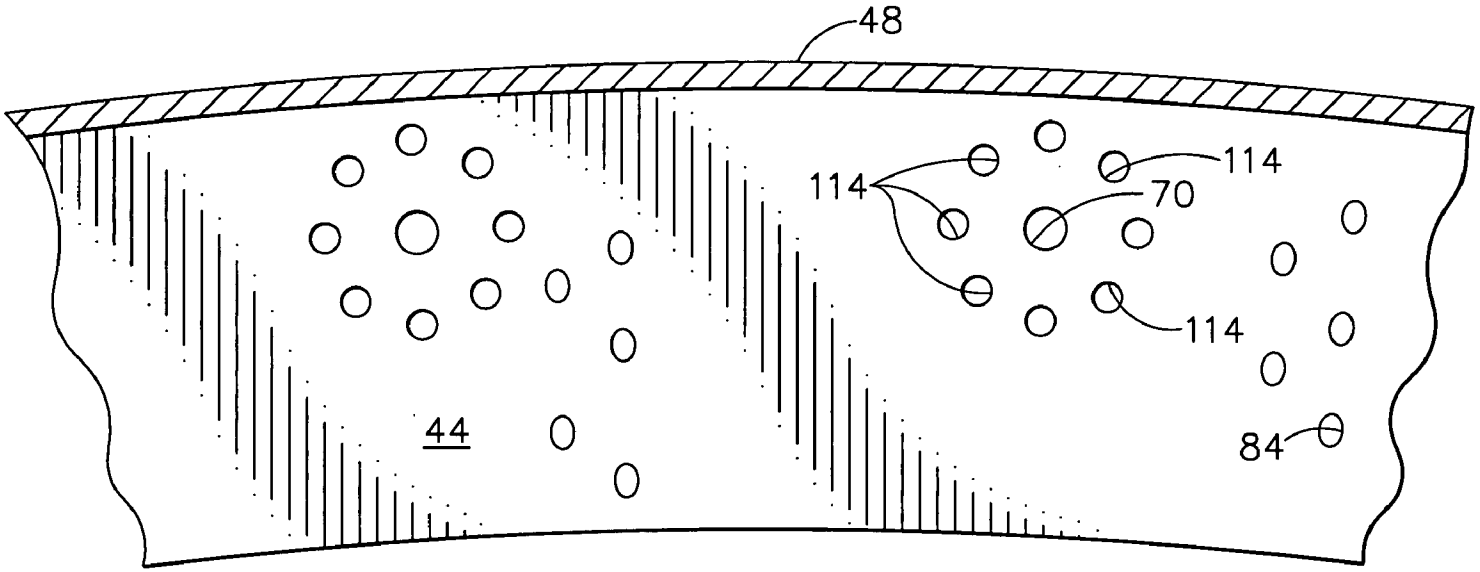
FIG. 4 is an elevated view illustration taken in a direction along 4—4 in FIG. 3.

Referring to FIG. 3 in particular, vortex driving aftwardly injected air 110 is injected through air injection first holes 112 in the forward wall 46 positioned radially along the forward wall positioned radially near the opening 42 at the radially inner end 39 of the cavity 40. Vortex driving forwardly injected air 116 is injected through air injection second holes 114 in the aft wall 44 positioned radially near the outer wall 48. Vortex fuel 115 is injected through fuel injection holes 70 in the aft wall 44 near the radially outer wall 48. Each of the fuel injection holes 70 are surrounded by several of the second holes 114 that are arranged in a circular pattern. The first holes 112 in the forward wall 46 are arranged in a singular circumferential row around the can axis 8 as illustrated in FIG. 4. However, other arrangements may be used including more than one row of the fuel injection holes 70 and/or the first holes 112.

Referring to FIG. 3, the vortex fuel 115 enters trapped vortex cavity 40 through a fuel injectors 68, which are centered within the fuel injection holes 70. The fuel injector 68 is in flow communication with an outer fuel manifold 74 that receives the vortex fuel 115 by way of a fuel conduit 72. In the exemplary embodiment of the invention, the fuel manifold 74 has an insulating layer 80 in order to protect the fuel manifold from heat and the insulating layer may contain either air or some other insulating material.

Figure 9:
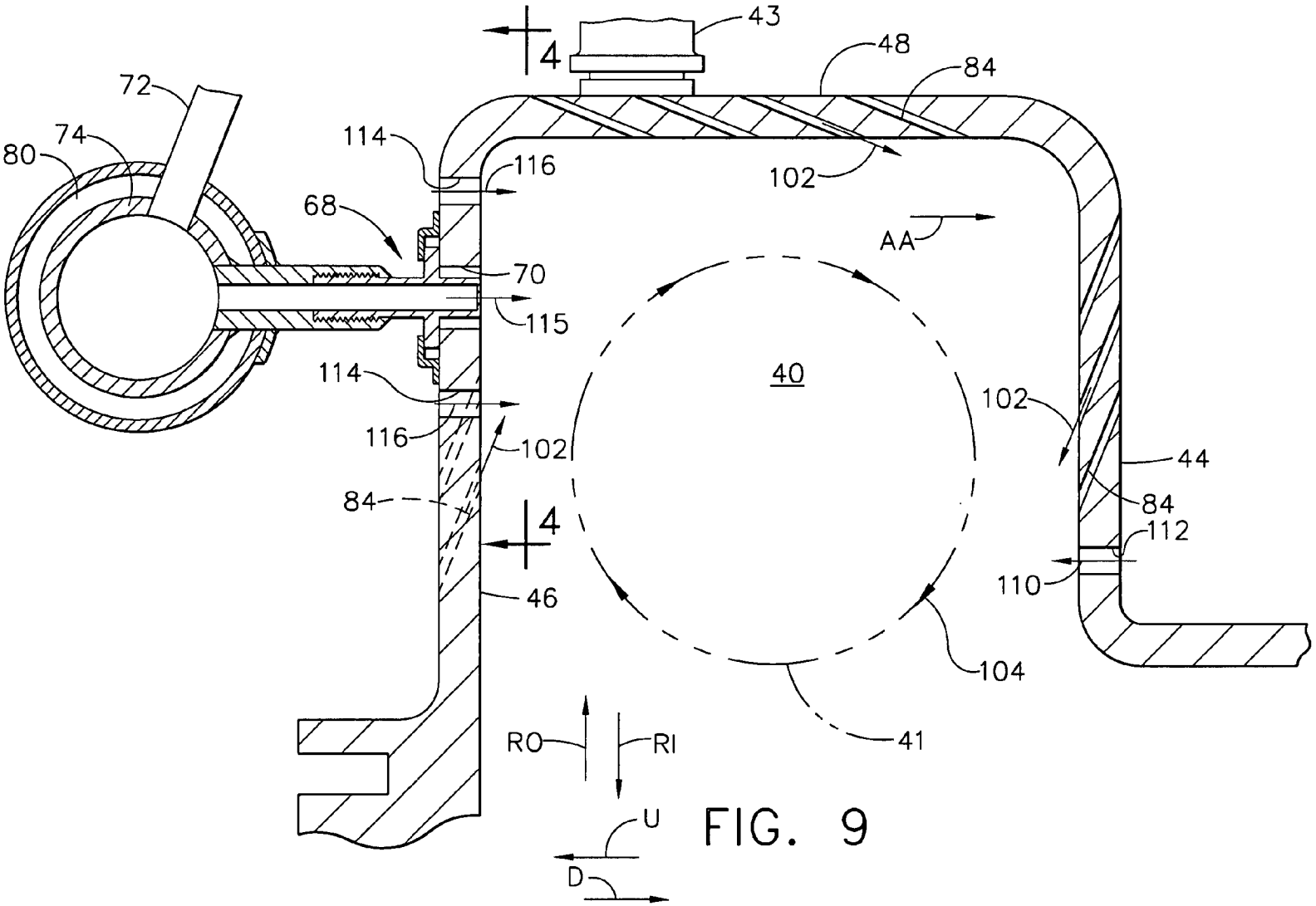
FIG. 9 is an enlarged view illustration of the trapped vortex cavity illustrated in FIG. 8.

Film cooling means, in the form of cooling apertures 84, such as cooling holes or slots angled through walls, are well known in the industry for cooling walls in the combustor. In the exemplary embodiment of the invention, film cooling apertures 84 disposed through the aft wall 44, the forward wall 46, and the outer wall 48 are used as the film cooling means. The film cooling apertures 84 are angled to help promote the vortex 41 of fuel and air formed within cavity 40 and are also used to cool the walls. The film cooling apertures 84 are angled to flow cooling air 102 in the direction of rotation 104 of the vortex. Due to the entrance of air in cavity 40 from the first and second holes 112 and 114 and the film cooling apertures 84, a tangential direction of the trapped vortex 41 at the cavity opening 42 of the vortex cavity 40 is downstream D, the same as that of the fuel/air mixture entering combustion chamber 26. This means that for a downstream D tangential direction of the trapped vortex 41 at the cavity opening 42 of the vortex cavity 40, the film cooling apertures 84 through the aft wall 44 are angled radially outwardly RO in the downstream direction D, the film cooling apertures 84 through the forward wall 46 are angled radially inwardly RI, and the film cooling apertures 84 through the outer wall 48 are angled axially forwardly AF. For an upstream U tangential direction of the trapped vortex 41 at the cavity opening 42 of the vortex cavity 40 of the vortex 41, the film cooling apertures 84 through the aft wall 44 are angled radially inwardly RI in the downstream direction D, the film cooling apertures 84 through the forward wall 46 are angled radially outwardly RO in the downstream direction D, and the film cooling apertures 84 through the outer wall 48 are angled axially aftwardly AA (see FIGS. 7 and 9).

Accordingly, the combustion gases generated by the trapped vortex within cavity 40 serves as a pilot for combustion of air and fuel mixture received into the combustion chamber 26 from the pre-mixer. The trapped vortex cavity 40 provides a continuous ignition and flame stabilization source for the fuel/air mixture entering combustion chamber 26. Since the trapped vortex performs the flame stabilization function, it is not necessary to generate hot gas recirculation zones in the main stream flow, as is done with all other low NOx combustors. This allows a swirl-stabilized recirculation zone to be eliminated from a main stream flow field in the can combustor. The primary fuel would be injected into a high velocity stream entering the combustion chamber without flow separation or recirculation and with minimal risk of auto-ignition or flashback and flame holding in the region of the fuel/air pre-mixer.

A trapped vortex combustor can achieve substantially complete combustion with substantially less residence time than a conventional lean pre-mixed industrial gas turbine combustor. By keeping the residence time in the combustion chamber relatively short, the time spent at temperatures above the thermal NOx formation threshold can be reduced, thus, reducing the amount of NOx produced. A risk to this approach is increased CO levels due to reduced time for complete CO burnout. However, it is believed that the flame zone of the combustion chamber is very short due to intense mixing between the vortex and the main air. The trapped vortex provides high combustor efficiency under much shorter residence time than conventional aircraft combustors. It is expected that CO levels will be a key contributor to determination of optimal combustor length and residence time.

Ignition, acceleration, and low-power operation would be accomplished with fuel supplied only to the trapped vortex. At some point in the load range, fuel would be introduced into the main stream pre-mixer. Radially inwardly flow of hot combustion products from the trapped vortex into the main stream would cause main stream ignition. As load continued to increase, main stream fuel injection would be increase and the trapped vortex fuel would be decreased at a slower rate, such that combustor exit temperature would rise. At full-load conditions, trapped vortex fuel flow would be reduced to the point that the temperature in the vortex would be below the thermal NOx formation threshold level, yet, still sufficient to stabilize the main stream combustion. With the trapped vortex running too lean to produce much thermal NOx and the main stream residence time at high temperature too short to produce much thermal NOx, the total emissions of the combustor would be minimized.

In the exemplary embodiment illustrated herein the combustor liner 27 includes a radially outerwardly opening annular cooling slot 120 that is parallel to the aft wall 44 and operable to direct and flow cooling air 102 along the aft wall 44. The combustor liner 27 includes a downstream opening annular cooling slot 128 is operable to direct and flow cooling air 102 downstream along the combustor liner 27 downstream of the cavity 40. The radially outerwardly opening cooling slot 120 and the downstream opening cooling slot 128 are parts of what is referred to as a cooling nugget 117.

Figure 8:
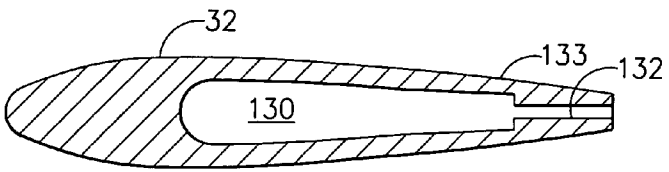
FIG. 8 is a longitudinal cross-sectional view illustration of a fuel vane in the reverse flow flowpath through 8—8 in FIG. 7.

Referring again to FIG. 2, the pre-mixer 28 includes an annular swirler 126 having a plurality of swirling vanes 32 circumferentially disposed about a hollow centerbody 45 across a pre-mixer flowpath 134 which extends through a pre-mixer tube 140. A fuel line 59 supplies fuel 22 to a fuel injector exemplified by fuel cavities 130 within the swirling vanes 32 (see FIG. 8) of the annular swirler 126. The fuel 22 is injected into the pre-mixer flowpath 134 through fuel injection holes 132 which extend through trailing edges 133 of the swirling vanes 32 from the fuel cavities 130 to the pre-mixer flowpath. An example of such a swirling vane 32 is illustrated in cross-section in FIG. 8. This is one primary fuel injection means for injecting fuel into the pre-mixer flowpath 134. Other means are well known in the art and include, but are not limited to, radially extending fuel rods that inject fuel in a downstream direction in the pre-mixer flowpath 134 and central fuel tubes that inject fuel radially into the pre-mixer flowpath 134. The pre-mixer tube 140 is connected to the combustor dome 29 and terminates at a pre-mixer nozzle 144 between the pre-mixer and the combustion chamber 26. The hollow centerbody 45 is capped by an effusion cooled centerbody tip 150.

Figure 5:
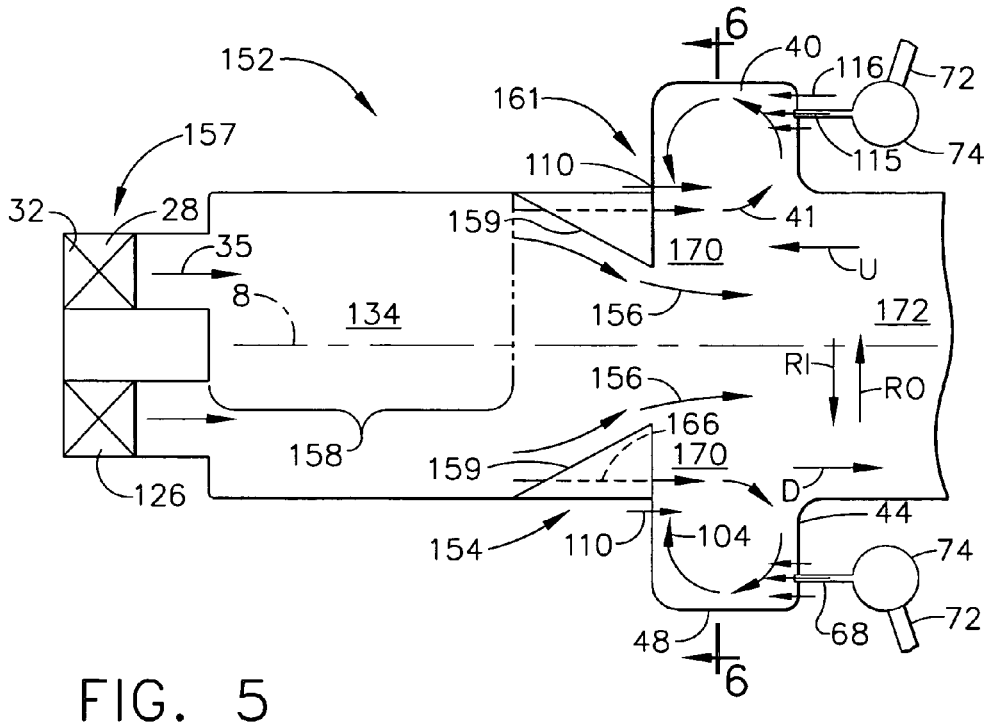
FIG. 5 is a longitudinal cross-sectional view schematic illustration of a first alternative can combustor with a convoluted mixer between the pre-mixer and the can combustor.

Illustrated in FIG. 5 is a two stage pre-mixer 152 wherein a first pre-mixing stage 157 includes the annular swirler 126. The swirling vanes 32 are circumferentially disposed about the hollow centerbody 45 across the pre-mixer flowpath 134 within the pre-mixer tube 140. The fuel line 59 supplies fuel to fuel cavities 130 within the swirling vanes 32 of the annular swirler 126 as further illustrated in FIG. 8. Downstream of the annular swirler 126 is a second pre-mixing stage 161 in the form of a convoluted mixer 154 located between the first pre-mixing stage 157 and the vortex cavity 40. The convoluted mixer 154 includes circumferentially alternating lobes 159 extending radially inwardly into the pre-mixer flowpath 134 and the fuel/air mixture flow 35.

Figure 6:
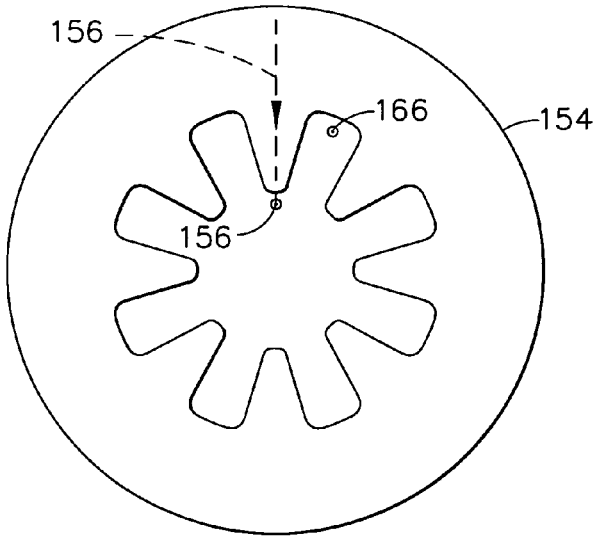
FIG. 6 is an elevated view illustration of the convoluted mixer taken in a direction along 6—6 in FIG. 5.

A pre-mixing zone 158 extends between the annular swirler 126 and the convoluted mixer 154. The lobes 159 of the convoluted mixer 154 direct a first portion 156 of the fuel/air mixture flow 35 from the pre-mixing zone 158 radially inwardly along the lobes 159 as illustrated in FIGS. 5 and 6. A second portion 166 of the fuel/air mixture flow 35 from the pre-mixing zone 158 passes between the lobes 159. The convoluted mixer 154 generates low pressure zones 170 in wakes immediately downstream of the lobes 159. This encourages gases in the vortex cavity 40 to penetrate deep into the fuel/air mixture flow 35 to provide good piloting ignition of the air/fuel mixture in a combustion zone 172 downstream of the vortex cavity 40 in the combustion chamber 26. The convoluted mixer 154 provides rapid mixing the combustion gases from the vortex cavity 40. Some of the vortex fuel 115 from the fuel injection holes 70 in the aft wall 44 near the radially outer wall 48 will impinge on the forward wall 46. This fuel flows radially inwardly up to and along an aft facing surface of the convoluted mixer 154 and gets entrained in the air/fuel mixture flow 35. This provides more mixing of the air/fuel mixture. The convoluted mixer 154 anchors and stabilizes a flame front of the air/fuel mixture in the combustion zone 172 and provides a high degree of flame stability.

Figure 7:
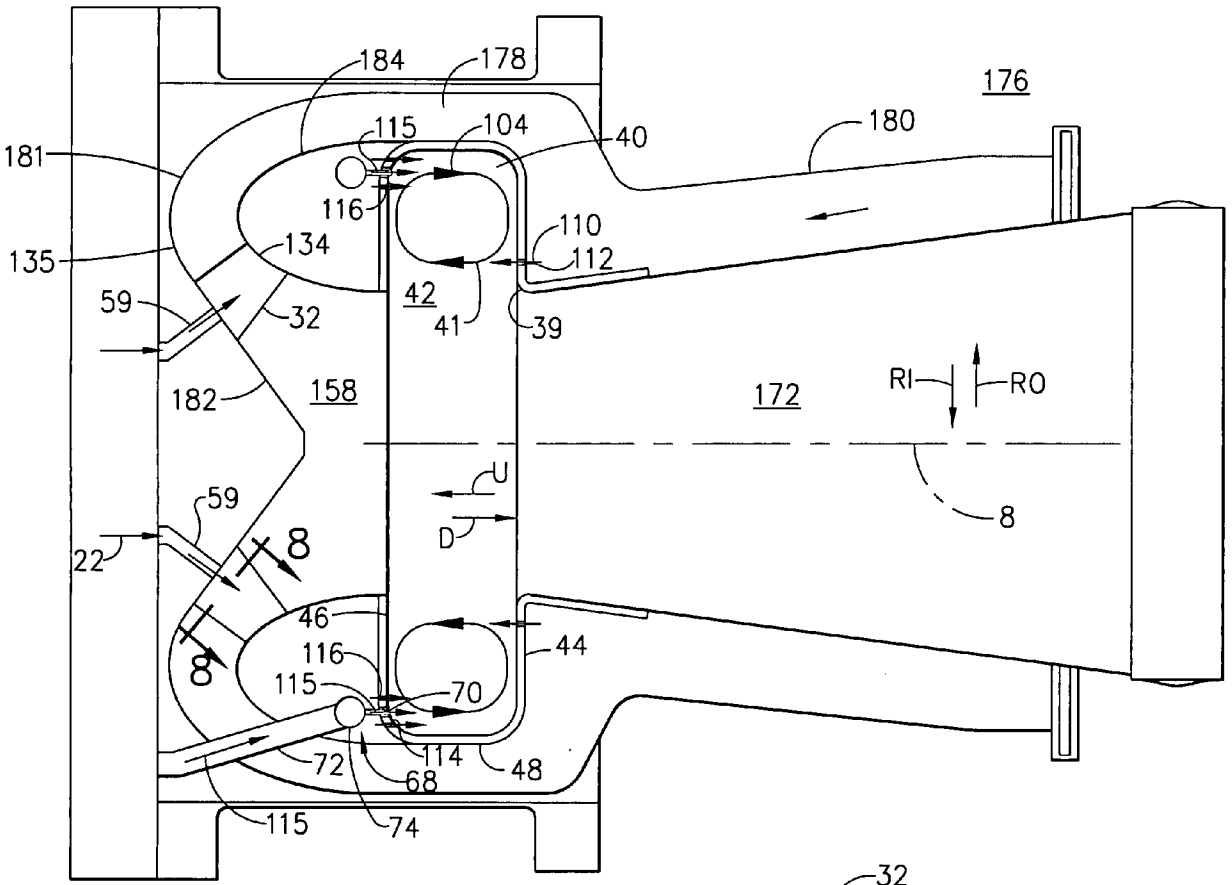
FIG. 7 is a longitudinal cross-sectional view schematic illustration of a second alternative can combustor with a reverse flow flowpath.

Illustrated in FIG. 7 is a dry low NOx single stage combustor 176 with a reverse flow combustor flowpath 178. The combustor flowpath 178 includes, in downstream serial flow relationship, an aft to forward portion 180 between an outer flow sleeve 182 and the annular combustor liner 27, a 180 degree bend 181 forward of the vortex cavity 40, and the pre-mixer flowpath 134 at a downstream end 135 of the combustor flowpath 178. The swirling vanes 32 of the pre-mixer 28 are disposed across the pre-mixer flowpath 134 defined between outer flow sleeve 182 and an inner flow sleeve 184. The fuel line 59 supplies fuel 22 to the fuel cavities 130 within the swirling vanes 32 of the annular swirler 126. The fuel is injected into the pre-mixer flowpath 134 through the fuel injection holes 132 extending through trailing edges 133 of the swirling vanes 32 from the fuel cavities 130 as illustrated in cross-section in FIG. 8.

Vortex driving aftwardly injected air 110 is injected through air injection first holes 112 in the aft wall 44. The first holes 112 are positioned lengthwise near the opening 42 at the radially inner end 39 of the cavity 40. Vortex driving forwardly injected air 116 is injected through air injection second holes 114 in the forward wall 46. The second holes 114 are positioned radially along the forward wall as close as possible to the outer wall 48. Vortex fuel 115 is injected through fuel injection holes 70 in the forward aft wall 46 near the radially outer wall 48. Each of the fuel injection holes 70 are surrounded by several of the second holes 114 that are arranged in a circular pattern. The first holes 112 in the aft wall 44 are arranged in a singular circumferential row around the can axis 8 as illustrated in FIG. 4.

Due to the entrance of air in cavity 40 from the first and second holes 112 and 114 and the film cooling apertures 84, a tangential direction of the trapped vortex 41 at the cavity opening 42 of the vortex cavity 40 is upstream which is opposite the downstream direction of the fuel/air mixture entering combustion chamber 26. This further promotes mixing of the hot combustion gases of the vortex 41.

Accordingly, the combustion gases generated by the trapped vortex within cavity 40 serves as a pilot for combustion of air and fuel mixture received into the combustion chamber 26 from the pre-mixer. The trapped vortex cavity 40 provides a continuous ignition and flame stabilization source for the fuel/air mixture entering combustion chamber 26. Since the trapped vortex performs the flame stabilization function, it is not necessary to generate hot gas recirculation zones in the main stream flow, as is done with all other low NOx combustors. The film cooling apertures within the cavities are angled to flow cooling air 102 in the rotational direction that the vortex is rotating. Due to the entrance of air in cavity 40 from the first and second holes 112 and 114 and the film cooling apertures 84, a tangential direction of the trapped vortex 41 at the cavity opening 42 of the vortex cavity 40 is downstream, the same as that of the fuel/air mixture entering combustion chamber 26.

Since the primary fuel would be injected into a high velocity stream through the swirler vanes with no flow separation or recirculation, the risk of auto-ignition or flashback and flame holding in the fuel/air pre-mixing region is minimized. It appears that a trapped vortex combustor can is able to achieve complete combustion with substantially less residence time than a conventional lean pre-mixed industrial gas turbine combustor. By keeping the residence time between the plane of the trapped vortex and the exit of the combustor can relatively short, the time spent at temperatures above the thermal NOx formation threshold can be reduced.

While there have been described herein what are considered to be preferred and exemplary embodiments of the present invention, other modifications of the invention shall be apparent to those skilled in the art from the teachings herein and, it is therefore, desired to be secured in the appended claims all such modifications as fall within the true spirit and scope of the invention.

Accordingly, what is desired to be secured by Letters Patent of the United States is the invention as defined and differentiated in the following claims:

1. A gas turbine engine combustor can assembly comprising:

a combustor can downstream of a pre-mixer;

said pre-mixer having a pre-mixer upstream end, a pre-mixer downstream end and a pre-mixer flowpath therebetween, a plurality of circumferentially spaced apart swirling vanes disposed across said pre-mixer flowpath between said upstream and downstream ends, and a primary fuel injection means for injecting fuel into said pre-mixer flowpath;

said swirling vanes disposed across said pre-mixer flowpath defined between an outer flow sleeve and an inner flow sleeve;

said combustor can having a combustion chamber surrounded by an annular combustor liner disposed in supply flow communication with said pre-mixer;

an annular trapped dual vortex cavity located at said upstream end of said combustor liner and defined between an annular aft wall, an annular forward wall, and a circular radially outer wall formed therebetween;

a cavity opening at a radially inner end of said cavity spaced apart from said radially outer wall and extending between said aft wall and said forward wall;

air injection first holes in said aft wall and air injection second holes in said forward wall, said air injection first and second holes spaced radially apart;

fuel injection holes in at least one of said forward and aft walls;

a reverse flow combustor flowpath including, in downstream serial flow relationship, an aft to forward portion between an outer flow sleeve and said annular combustor liner, a 180 degree bend forward of said vortex cavity, and said pre-mixer flowpath at a downstream end of said combustor flowpath.

2. A combustor can assembly as claimed in claim 1, further comprising:

angled film cooling apertures disposed through said aft wall, said forward wall, and said outer wall, said film cooling apertures through said aft wall are angled radially inwardly, said film cooling apertures through said forward wall are angled radially outwardly in a downstream direction, said film cooling apertures through said outer wall are angled axially aftwardly, and said fuel injection holes are disposed through said forward wall.

3. A combustor can assembly as claimed in claim 2, wherein said primary fuel injection means includes fuel cavities within said swirling vanes, fuel injection holes extending through trailing edges of said swirling vanes from the fuel cavities to said pre-mixer flowpath.

4. A combustor can assembly as claimed in claim 2, further comprising angled film cooling apertures disposed through said aft wall, said forward wall, and said outer wall.

5. A combustor can assembly as claimed in claim 2, wherein each of said fuel injection holes is surrounded by a plurality of said air injection second holes and said air injection first holes are singularly arranged in a circumferential row.

6. A gas turbine engine combustor can assembly comprising:

a combustor can downstream of a pre-mixer;

said pre-mixer having a pre-mixer upstream end, a pre-mixer downstream end and a pre-mixer flowpath therebetween, a plurality of circumferentially spaced apart swirling vanes disposed across said pre-mixer flowpath between said upstream and downstream ends, and a primary fuel injection means for injecting fuel into said pre-mixer flowpath;

said combustor can having a combustion chamber surrounded by an annular combustor liner disposed in supply flow communication with said pre-mixer;

an annular trapped dual vortex cavity located at said upstream end of said combustor liner and defined between an annular aft wall, an annular forward wall, and a circular radially outer wall formed therebetween;

a cavity opening at a radially inner end of said cavity spaced apart from said radially outer wall and extending between said aft wall and said forward wall;

air injection first holes in said forward wall and air injection second holes in said aft wall, said air injection first and second holes spaced radially apart;

fuel injection holes in at least one of said forward and aft walls;

angled film cooling apertures disposed through said aft wall, said forward wall, said and outer wall; and a second stage pre-mixing convoluted mixer located between said pre-mixer and said vortex cavity and including circumferentially alternating lobes extending radially inwardly into said pre-mixer flowpath.

7. A combustor can assembly as claimed in claim 6, further comprising angled film cooling apertures disposed through said aft wall, said forward wall, and said outer wall.

8. A combustor can assembly as claimed in claim 7, further comprising:

said film cooling apertures through said aft walls are angled radially outwardly, said film cooling apertures through said forward walls are angled radially inwardly in a downstream direction, said film cooling apertures through said outer wall are angled axially forwardly, said fuel injection holes and said air injection second holes are disposed through said aft wall, and said air injection first holes are disposed through said forward wall.

9. A combustor can assembly as claimed in claim 8, wherein each of said fuel injection holes is surrounded by a plurality of said air injection second holes and said air injection first holes are singularly arranged in a circumferential row.

* * * * *